US007618550B2

(12) United States Patent
Greuter et al.

(10) Patent No.: US 7,618,550 B2
(45) Date of Patent: Nov. 17, 2009

(54) POLYMER COMPOUND WITH NONLINEAR CURRENT-VOLTAGE CHARACTERISTIC AND PROCESS FOR PRODUCING A POLYMER COMPOUND

(75) Inventors: Felix Greuter, Rütihof (CH); Yvo Dirix, Zürich (CH); Petra Kluge-Weiss, Dättwil (CH); Walter Schmidt, Bellikon (CH); Reto Kessler, Zürich (CH)

(73) Assignee: ABB Research Ltd, Zurich (CH)

( * ) Notice: Subject to any disclaimer, the term of this patent is extended or adjusted under 35 U.S.C. 154(b) by 0 days.

(21) Appl. No.: 11/892,148

(22) Filed: Aug. 20, 2007

(65) Prior Publication Data

US 2008/0023678 A1 Jan. 31, 2008

Related U.S. Application Data

(63) Continuation of application No. 10/180,078, filed on Jun. 27, 2002, now Pat. No. 7,320,762.

(30) Foreign Application Priority Data

Jul. 2, 2001 (EP) ..... 01810645

(51) Int. Cl.
*H01C 7/10* (2006.01)

(52) U.S. Cl. ..... 252/62.2; 252/500; 252/518.1; 338/22 R; 338/22 SD; 338/20; 338/21

(58) Field of Classification Search ..... 252/62.2, 252/500, 519.1, 519.15; 338/20, 22 R, 22, 338/22 SD; 264/453, 478; 428/357, 402; 524/430, 532

See application file for complete search history.

(56) References Cited

U.S. PATENT DOCUMENTS 3,689,863 A 9/1972 Matsuoka et al.
4,003,855 A * 1/1977 Wong ..... 252/519.13
4,169,071 A * 9/1979 Eda et al. ..... 252/517
4,175,152 A 11/1979 Carnahan et al.
4,176,142 A 11/1979 Lewis et al.
4,297,250 A * 10/1981 Gupta et al. ..... 252/519.3
4,559,167 A 12/1985 Julke et al.

(Continued)

FOREIGN PATENT DOCUMENTS

CH 664231 2/1988

(Continued)

OTHER PUBLICATIONS

Strumpler, R., et al., "Smart Varistor Composites", Intelligent Materials and Systems, 1995, pp. 15-22.

(Continued)

*Primary Examiner*—Stanley Silverman
*Assistant Examiner*—Kallambella Vijayakumar
(74) *Attorney, Agent, or Firm*—Buchanan Ingersoll & Rooney PC

(57) ABSTRACT

The polymer compound contains a polymer matrix and a filler embedded in the matrix. The filler comprises two filler components with nonlinear current-voltage characteristics deviating from one another. By selection of suitable amounts of these filler components, a polymer compound with a predetermined nonlinear current-voltage characteristic deviating from these two characteristics can be formed in this way.

2 Claims, 2 Drawing Sheets

U.S. PATENT DOCUMENTS

| | | | | |
|---|---|---|---|---|
| 4,981,624 | A | 1/1991 | Tsuda et al. | |
| 5,166,658 | A | 11/1992 | Fang et al. | |
| 5,414,403 | A | 5/1995 | Greuter et al. | |
| 5,669,381 | A | 9/1997 | Hyatt | |
| 5,858,533 | A | 1/1999 | Greuter et al. | |
| 6,124,549 | A * | 9/2000 | Kemp et al. | 174/73.1 |
| 6,334,964 | B1 | 1/2002 | Cowman et al. | |
| 6,469,611 | B1 * | 10/2002 | Kluge-Weiss et al. | 338/20 |

FOREIGN PATENT DOCUMENTS

| | | | |
|---|---|---|---|
| DE | 2363172 | | 6/1975 |
| DE | 19821239 | A1 | 11/1999 |
| EP | 0875087 | B1 | 11/2000 |
| WO | WO 99/56290 | * | 11/1999 |

OTHER PUBLICATIONS

Strumpler, R., et al., "Smart Varistor Composites", Proceednigs of 8th CIMTEC-World Ceramic Congress and Forum on New Materials, Florence, Italy, Jun. 29-Jul. 4, 1994, pp. 1-8.

Western Electric Components Corp., "PTC Engineering Notes," four pages, downloaded from internet www.wecc.com/ptceng.html (Feb. 27, 2006).

Powercet Corporation, "Metal Oxide Varistors," four pages, Prepared by EFI Electronics Corporation, Salt Lake City, Utah (Nov. 2, 1998).

Wikipedia, 2006, pp. 1-2.

Terahsima et al., "Grain Growth: Zener Pinning of Grain Boundaries by Oxide particles," University of Cambridge, 2005, pp. 1-4.

Cullity, B. D., "Structure of Polycrystalline Aggregates", Elements of X-Ray Diffraction, 1978, pp. 281-283, Second Edition, Addison-Wesley Publishing Company, Inc.

"Crystallite", Wikipedia, 3 pp.

M. Imataki, et al., "Advanced Metal Oxide Surge Arrestor for Gas Insulated Switchgear (GIS)," IEEE Transaction on Power Apparatus and Systems, vol. PAS-103, No. 10, Oct. 1984,Mitsubishi Electric Corporation, Amagasaki, Japan, pp. 2990-2998.

Edward Sonder et al., "ZnO Varistors Made From Powders Produced Using a Urea Process," Ceramic Bulletin, vol. 65, No. 4 (1986), pp. 665-668.

K.A. Hu, "Composite Thermistors" *Tailoring Multiphase and Composite Ceramics*, Materials Science Research, vol. 20, pp. 475-478, Plenum Press, New York and London.

* cited by examiner

POLYMER COMPOUND WITH NONLINEAR CURRENT-VOLTAGE CHARACTERISTIC AND PROCESS FOR PRODUCING A POLYMER COMPOUND

FIELD

This application is a Continuation of Ser. No. 10/180,078 filed Jun. 27, 2002, now U.S. Pat. No. 7,320,762.

The invention is based on a polymer compound and on a process for preparing a polymer compound. The polymer compound contains a polymer matrix, in which electrically conducting particles, such as conductive carbon black, and/or metal powder and/or electrically semiconducting particles, such as SiC or ZnO for instance, are embedded as a filler. This polymer compound has a nonlinear current-voltage characteristic, which is influenced by the filler content and the dispersion of the filler. The resistivity determined by the current-voltage characteristic and other electrical properties can generally be influenced on the basis of the strength of an electric field applied to the polymer compound only by means of the filler content and the degree of dispersion.

The polymer compound can be used with advantage as a base material in voltage-limiting resistors (varistors) or as a field-controlling material in power engineering installations and apparatuses, such as in particular in cable potheads or in cable-jointing sleeves.

BACKGROUND

A polymer compound of the type stated at the beginning and a process of the type stated at the beginning are described in an article by R. Strümpler et al. "Smart Varistor Composites" Proc. of the 8th CIMTEC Ceramic Congress, June 1994 and in EP 875 087 B1 and WO 99/56290 A1. Doped and sintered particles of zinc oxide are provided as the filler in this polymer compound.

Typical dopants are metals, as are used in the production of metal oxide varistors and typically comprise Bi, Cr, Co, Mn and Sb. Doped ZnO powder is sintered at 800 to 1300° C. Desired electrical properties of the filler are achieved by suitable sintering temperatures and times. After the sintering, each particle has an electrical conductivity which changes as a nonlinear function on the basis of the applied electric field. Each particle therefore acts as a small varistor. The nonlinear behavior of the filler can be set within certain limits by the suitable sintering conditions. The nonlinear electrical properties of the polymer compound can therefore be set during the preparation of the compound not only by means of the filler content and the degree of dispersion but also by means of the sintering conditions of the filler.

SUMMARY

The invention, as it is specified in the patent claims, is based on the object of providing a polymer compound of the type stated at the beginning, of which the nonlinear electrical properties can be set in an easy. way during the preparation process, and a process for preparing such a polymer compound with which polymer compounds with prescribed nonlinear electrical properties can be produced in a cost-effective way.

In the case of the polymer compound according to the invention, the filler contains at least two filler components with nonlinear current-voltage characteristics deviating from one another. By selecting suitable amounts of these filler components, a polymer compound with a nonlinear current-voltage characteristic deviating from these two characteristics can consequently be achieved. The polymer compound according to the invention is therefore distinguished by the fact that, in spite of precisely defined nonlinear electrical properties, it can be prepared with little expenditure. A small basic set of filler components, each with a defined nonlinear current-voltage characteristic, can be used to produce polymer compounds with virtually any desired current-voltage characteristics.

By combining the two filler components, the polymer compound can not only be imparted predetermined electrical properties, but its thermal conductivity can also be influenced decisively in this way. When using polymer compounds as a field-control material, for instance in cable harnesses, this is particularly important, since the cable harness is strongly heated because of dielectric losses in the polymer compound and because of electrical losses in the metallic conductor. The generally low thermal conductivity of the polymer is neutralized by suitably selected filler components, which, along with the good electrical behavior, also give the polymer compound adequately good thermal conductivity.

In applications of the polymer compound in which, as in the case of surge arresters or field-control material, nonlinear electrical behavior is of primary importance, it is particularly advantageous if the two filler components are formed in each case by a doped, sintered metal oxide with particles containing grain boundaries and differ from one another by deviating stoichiometry of the dopants and/or by having grain boundary structures which deviate from one another, have different grain sizes and are caused by different sintering conditions. The metal oxide is generally zinc oxide, but may also advantageously be tin dioxide or titanium dioxide. The current-voltage characteristics deviating from one another can be achieved by different proportions by weight of the dopants, i.e. by different formulations of the two filler components, or by different conditions during the sintering of the filler components. The sintering conditions comprise, in particular, the sintering temperature, the residence time, the gas composition of the sintering atmosphere and the heating-up and cooling-down rates. Generally speaking, with a given electric field strength, the conductivity of powdered zinc oxide doped with a number of metals can be increased by increasing the sintering temperature.

To change the current-voltage characteristic, the polymer compound may contain electrically conducting or electrically semiconducting material, such as conductive carbon black or metal powder for instance. However, this material achieves in particular the effect of better contacting of the individual particles of the filler components having nonlinear electrical behavior. In this way, the energy absorption of the polymer compound is increased significantly. A surge arrester containing a polymer compound according to the invention is then distinguished by a high surge resistance. To achieve an adequate effect, the proportion of the additional component should amount to 0.01 to 15 percent by volume of the polymer compound.

To perform field-controlling tasks, it is of particular advantage if the additional component contains particles with a large length-to-diameter ratio, such as in particular nanotubes. If the polymer matrix is aligned in a preferential direction during the preparation of the polymer compound, for instance by injection molding, these particles can be oriented in the preferential direction because of the large length-to-diameter ratio, and consequently a polymer compound with anisotropic electrical properties can be achieved in an easy way. Such a material can be used with advantage for performing field-controlling tasks in cable-jointing sleeves or in cable potheads.

If doped metal oxide, such as doped zinc oxide for instance, is used as the filler, the polymer compound has a high relative permittivity. The polymer compound according to the invention can then control an electric field in an easy way. Such field control may concern, for example, the homogenization of the distribution of electric fields of power engineering installations or apparatuses during normal operation. The field-controlling function of the polymer according to the invention can be improved by the filler having an additional component of a material with a high relative permittivity. Such additional components are, for example, $BaTiO_3$ or $TiO_2$.

The polymer matrix typically contains a single polymer or a mixture of polymers. The dielectric behavior of the polymer compound can be further improved as a result, if the single polymer or at least one of the polymers of the mixture contains polar groups and/or is an intrinsically electrically conductive polymer. A typical polymer with polar groups is, for example, a polyamide. The proportion of polymer containing polar groups and/or intrinsically electrically conductive polymer advantageously amounts to 0.01 to 50 percent by volume of the polymer matrix.

An additive which contains at least one stabilizer, one flame retardant and/or one processing aid may be additionally provided in the polymer compound. The proportion of this additive may amount to between 0.01 and 5 percent by volume of the polymer compound.

A flameproofed polymer compound can be produced particularly cost-effectively if it contains aluminum hydroxide and/or magnesium hydroxide, acting as the flame retardant. Since, for flameproofing reasons, in many cases the polymer matrix must not go below a prescribed LOI (Limited Oxygen Index) value (the smaller the LOI value, the easier the polymer compound can burn), the LOI value can be increased in an extremely low-cost way by using the inexpensively available hydroxides.

The polymer compound has good mechanical strength if a coupling agent, increasing the adhesion between the polymer and the filler, is additionally provided. The proportion of coupling agent should amount to between 0.01 and 5 percent by volume of the polymer compound. The coupling agent, which preferably takes the form of silane, couples the polymer matrix firmly to the filler. Cracking in the polymer compound on account of inadequate adhesion of the polymer matrix to the filler, and ensuing material rupture, is consequently avoided with great certainty. At the same time, the coupling agent improves the electrical properties of the polymer compound according to the invention quite significantly. This is, in particular, because the formation of small voids in the polymer compound is avoided by the improved adhesion, and consequently the risk of undesired partial discharges occurring during the action of a strong electric field is reduced quite significantly. This effect is particularly advantageous in the case of a polymer compound based on an elastomeric polymer, as is used for instance as a field-control element for cable potheads or cable-jointing sleeves, since the compound can then be greatly deformed without undesired cavity formation or cracking occurring.

In the case of the process according to the invention for preparing a polymer compound, the filler is mixed from a basic set of at least two filler components with nonlinear current-voltage characteristics deviating from one another. In this case, the mixing ratio of the components is selected such that the polymer compound has the predetermined characteristic. The polymer compound can then be produced in an easy and cost-effective way without extensive preliminary investigations. For particularly easy production, it is recommendable for the mixing ratio to be selected from a predetermined family of characteristics of polymer compounds, of which two in each case contain at most one of the at least two filler components and at least one further one contains the at least two filler components mixed with a prescribed ratio.

BRIEF DESCRIPTION OF THE DRAWINGS

Exemplary embodiments of the invention are explained with reference to drawings.

DETAILED DESCRIPTION

According to known processes, described for example in the prior art cited at the beginning, varistor powders R1, R2, S1 and S2 were prepared. The powders contained as the main constituent (more than 90 mole percent) sintered zinc oxide, which was doped with additives, predominantly Sb, Bi, Co, Mn and Cr (altogether less than 10 mole percent). The varistor powder R1 had a smaller proportion of bismuth than the varistor powder R2. The powders R1 and R2 were prepared under the same sintering conditions, that is by sintering at approximately 1100° C. in a ceramic tube of a rotary kiln. The powders S1 and S2 had the same composition, but were prepared under different sintering conditions. The powder S1 was prepared by a continuous sintering process in a rotary kiln at a maximum sintering temperature of approximately 1070° C.; the powder S2 was prepared in a batch furnace at a maximum sintering temperature of approximately 1200° C. and for a residence time of the batches in the furnace of approximately 18 hours. By screening, possibly preceded by grinding, the particle sizes of the powders were restricted to values which typically lay between 32 and 125 μm.

The varistor powders were used to prepare mixtures, the compositions of which can be seen from the following table:

| | Filler component in % by weight | | | |
|---|---|---|---|---|
| Filler | R1 | R2 | S1 | S2 |
| R1 | 100 | — | — | — |
| R82 | 80 | 20 | | |
| R55 | 50 | 50 | — | — |
| R28 | 20 | 80 | — | — |
| R2 | — | 100 | — | — |
| S1 | — | — | 100 | — |
| S73 | — | — | 70 | 30 |
| S37 | — | — | 30 | 70 |
| S2 | — | — | — | 100 |

A mold made of plastic, formed as an electrically insulating tube, with an inside diameter of 1 to 2 centimeters, was filled with filler to a height of 2 to 5 millimeters. To have a basis for comparison, the same amounts of filler, for example 50% by volume of the compound to be prepared, were always introduced. The filler was impregnated with oil, for example a silicone oil or ester oil, under vacuum conditions and specimens comparable with a polymer compound were formed in this way. These specimens were electrically connected up to electrodes at the top and bottom in the vertically held tube and sealed liquid-tight.

Oil was used as the matrix material, since it allowed specimens to be produced in a particularly easy way. Instead of oil, however, a thermoset, an elastomer, a thermoplastic, a copolymer, a thermoplastic elastomer or a gel or a mixture of at least two of these substances can also be used.

A variable DC voltage source was applied to the two electrodes. By changing the level of the DC voltage, the electric field E [V/mm] acting in the assigned specimen was set and the current flowing in the specimen was measured. The DC current-voltage characteristics which can be seen in FIGS. 1 and 2 were thus obtained from the current density J [A/cm$^2$] ascertained from this.

Figure 1:
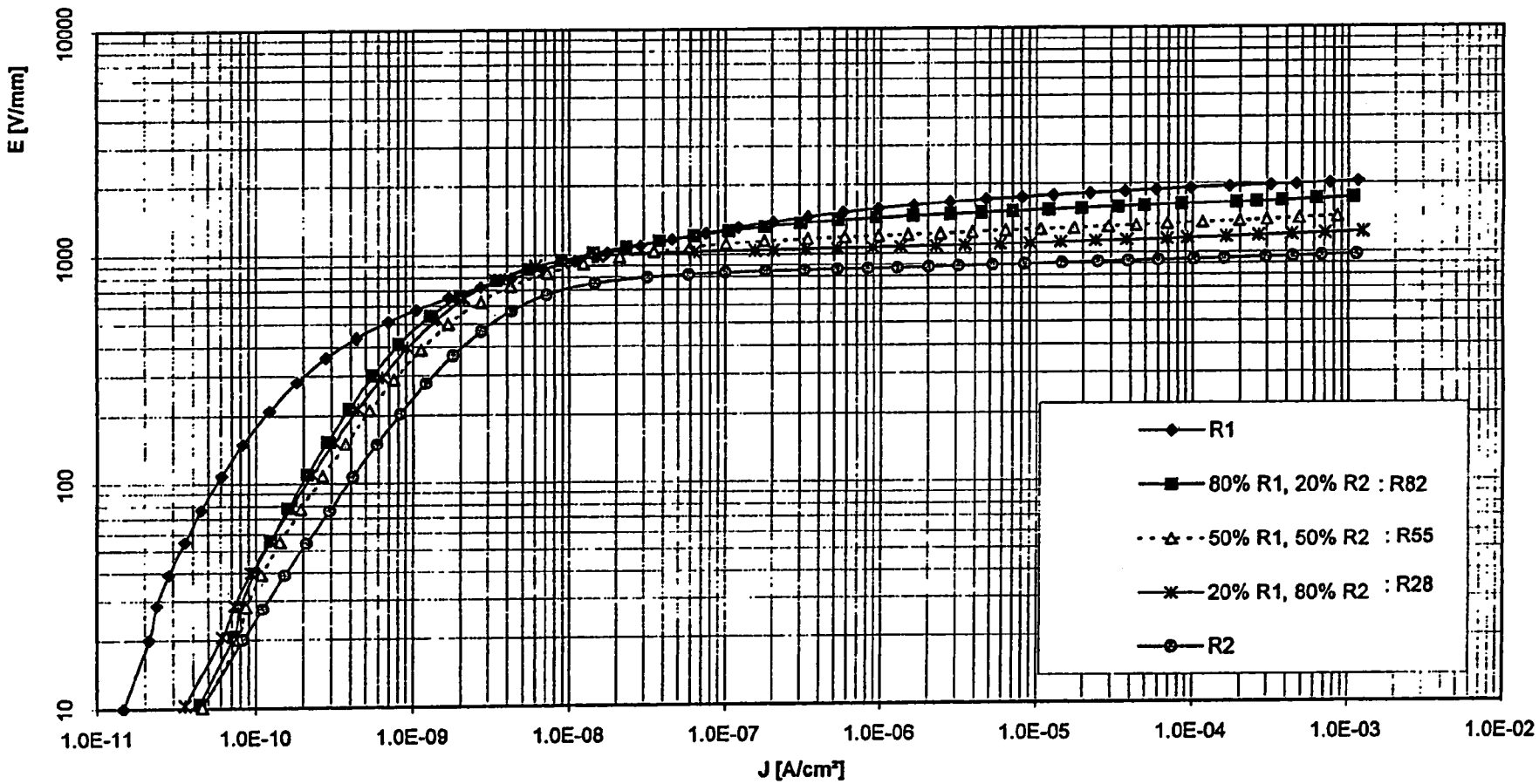
FIGS. 1 and 2 show DC current-voltage characteristics of polymer compounds according to the prior art and according to the invention (families of characteristic curves).

It can be seen from FIG. 1 that the fillers R82, R55 and R28 formed by mixing the two filler components R1 and R2 having different stoichiometry lead to specimens whose DC current-voltage characteristics belong to a family of characteristics which is bounded by the characteristics of the specimens filled with R1 and R2. By changing the mixing ratio of the two filler components, specimens with characteristics which lie between the two limiting characteristics were consequently obtained in an easy way.

Figure 2:
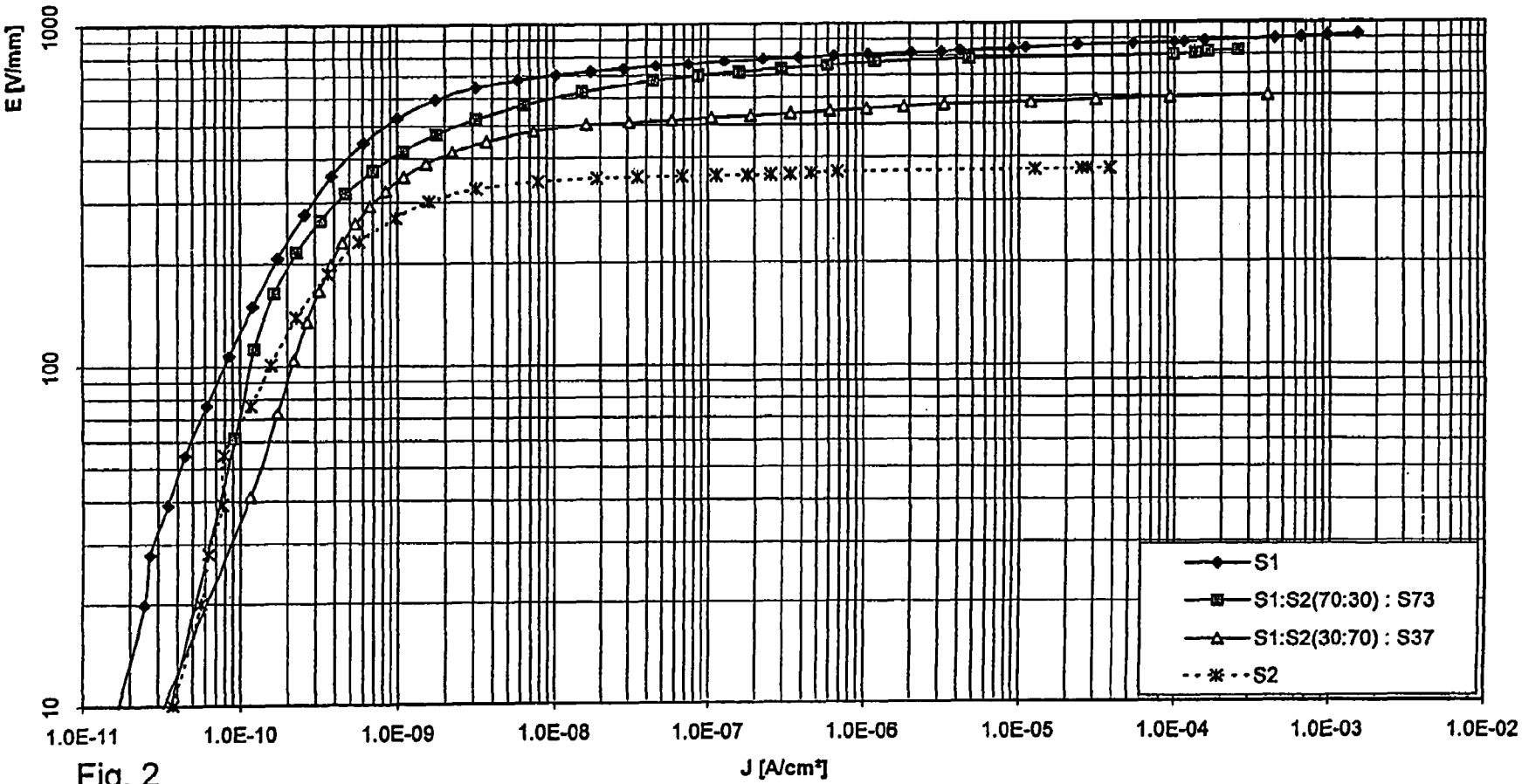

It can correspondingly be seen from FIG. 2 that the fillers S73 and S37 formed by mixing the two filler components S1 and S2 produced under different sintering conditions lead to specimens whose DC current-voltage characteristics belong to a family of characteristics of the specimens filled with S1 and S2. By changing the mixing ratio of the two filler components, specimens with characteristics which lie between the two limiting characteristics were also obtained with these fillers in an easy way.

So, if a polymer compound with a prescribed characteristic is to be prepared, the mixing ratio can be determined from a family of characteristics ascertained in a corresponding way for polymer compounds. By mixing the filler components according to this mixing ratio, the filler is created and the desired polymer compound produced by mixing the filler with polymer, for example silicone.

The same also applies correspondingly to polymer compounds with fillers which are achieved by mixing the filler components R1 or R2 and S1 or S2 or by mixing three or four of these filler components.

The filler components do not necessarily have to be formed from ZnO powder. They may also contain a different powdered material with a nonlinear current-voltage characteristic, such as doped silicon carbide, tin dioxide or titanium dioxide for instance.

By suitable addition of electrically conducting or electrically semiconducting material, for example Si, the electrical conductivity of the polymer compound in the range of small electric field strengths can be increased by several orders of magnitude, and consequently a polymer with a flat DC current-voltage characteristic can be achieved.

The invention claimed is:

1. A voltage-dependent polymer compound with a nonlinear current-voltage characteristic comprising a polymer matrix and a filler with a nonlinear current-voltage characteristic embedded in the matrix, wherein the filler comprises at least two filler components with nonlinear current-voltage characteristics deviating from one another, and the two filler components are formed by particles having particle sizes in a predetermined single particle size range containing a doped, sintered metal oxide with grain boundaries and having the same composition, the two filler components differing from one another by grain boundary structures deviating from one another and caused by different sintering conditions.

2. The polymer compound of claim 1, wherein the single particle size range is about 32 μm to about 125 μm.

* * * * *

UNITED STATES PATENT AND TRADEMARK OFFICE

CERTIFICATE OF CORRECTION

PATENT NO. : 7,618,550 B2
APPLICATION NO. : 11/892148
DATED : November 17, 2009
INVENTOR(S) : Felix Greuter et al.

It is certified that error appears in the above-identified patent and that said Letters Patent is hereby corrected as shown below:

Title Page, Item (73) Assignee: change "ABB Research Ltd., Zurich (CH)" to

-- ABB Schweiz AG, Baden, Switzerland --.

Signed and Sealed this
Twentieth Day of September, 2011

David J. Kappos

David J. Kappos
*Director of the United States Patent and Trademark Office*